US005261868A

United States Patent [19]

Pryor, Jr. et al.

[11] Patent Number: 5,261,868

[45] Date of Patent: Nov. 16, 1993

[54] EXERCISE DEVICE

[76] Inventors: Joe E. Pryor, Jr., 1 Manchester Blvd., Inglewood, Calif. 90301; Paul B. Stephan, 15222 Warwick Cir., Westminster, Calif. 92683; Montel B. Williams, 7800 Beverly Blvd., #231, Los Angeles, Calif. 90036

[21] Appl. No.: 868,633

[22] Filed: Apr. 14, 1992

[51] Int. Cl.[5] ..... A63B 23/02; A61H 1/02

[52] U.S. Cl. ..... 482/142; 482/144; 482/23; 606/241

[58] Field of Search ..... 482/148, 23, 95, 140, 482/142, 141, 143, 142, 28, 29, 33, 35, 36, 37, 38, 39, 41–43; 606/241

[56] References Cited

U.S. PATENT DOCUMENTS

| | | | |
|---|---|---|---|
| 1,779,903 | 10/1930 | Paragon | 482/24 |
| 3,006,643 | 10/1961 | Ryan | 482/142 |
| 3,874,657 | 4/1975 | Niebojewski | 482/23 |
| 4,638,995 | 1/1987 | Wilson | 482/142 |
| 4,759,539 | 7/1988 | Nieppola | 182/95 |
| 4,830,367 | 5/1989 | Foran | 482/140 |
| 4,838,250 | 6/1989 | Angelo | 482/142 |
| 5,080,352 | 1/1992 | Freed | 482/140 |

FOREIGN PATENT DOCUMENTS

| | | | |
|---|---|---|---|
| 2315291 | 1/1977 | France | 482/23 |

OTHER PUBLICATIONS

Alantic Fitness Products cataloge 482148 Nov. 1 1985 p. 17, Deluxe Hip Flexor.

*Primary Examiner*—Stephen R. Crow
*Assistant Examiner*—Jerome Donnelly

[57] ABSTRACT

Disclosed is an exercise device 10 including an elongated upright ladder section 14 which has at an upper end a body support section. There is a base 12 adapted to rest on a horizontal surface and support in a stable, vertical orientation the upright section. The body support section includes a seat rest support member 16 oriented substantially horizontally and adapted to be sat upon by a user and a second support member spaced from the seat rest support member and adapted to be gripped by the user with either legs or hands depending on the exercise being performed. A generally flat, planar, back support 84 has its upper end pivotally mounted to the seat rest support member 16 and a lower free end movable between a first position where the back support is generally vertical and a second position where the back support pivots and is at an acute angle with respect to the upright section 14.

18 Claims, 5 Drawing Sheets

FIG. 3
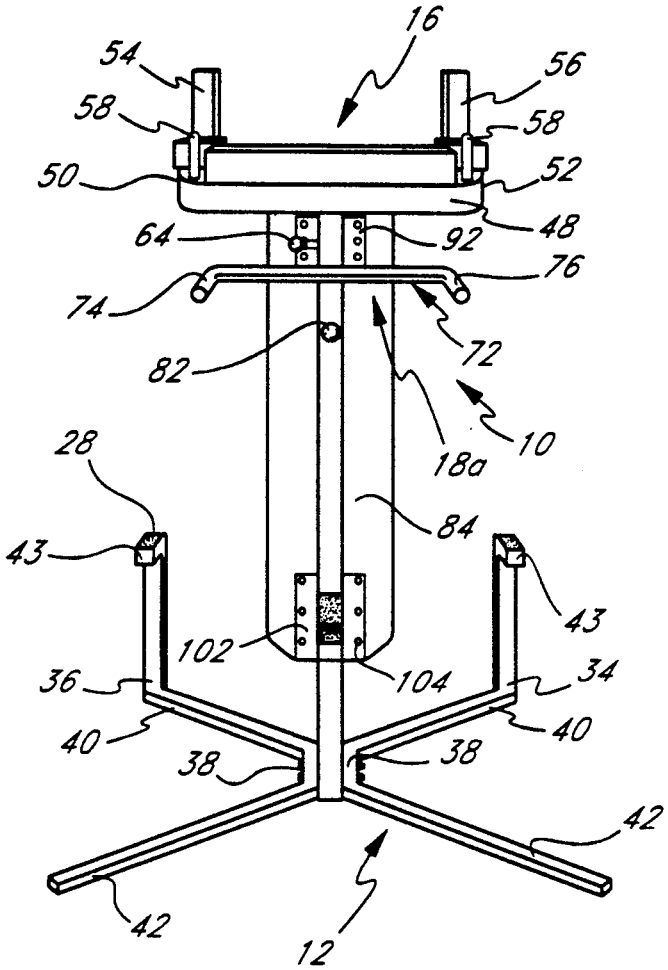
FIG. 7
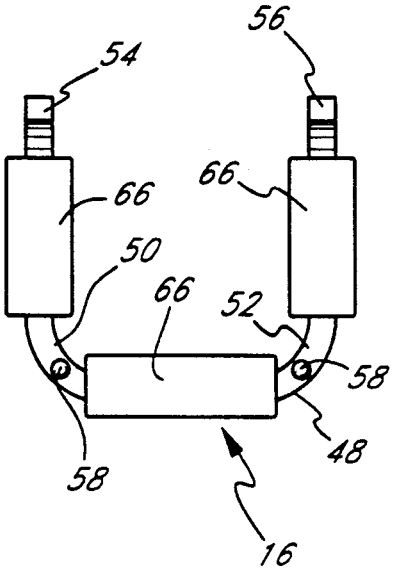
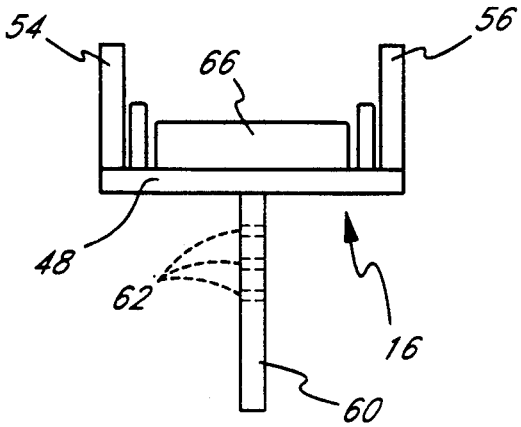
FIG. 8
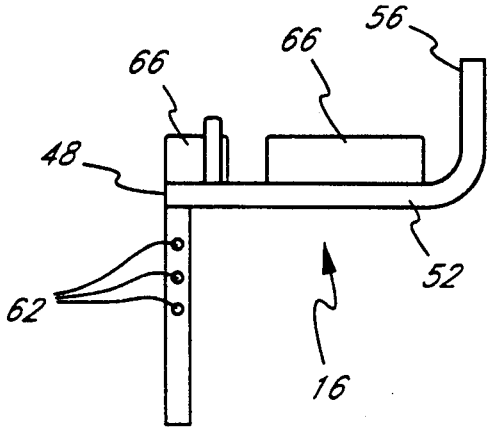
FIG. 9

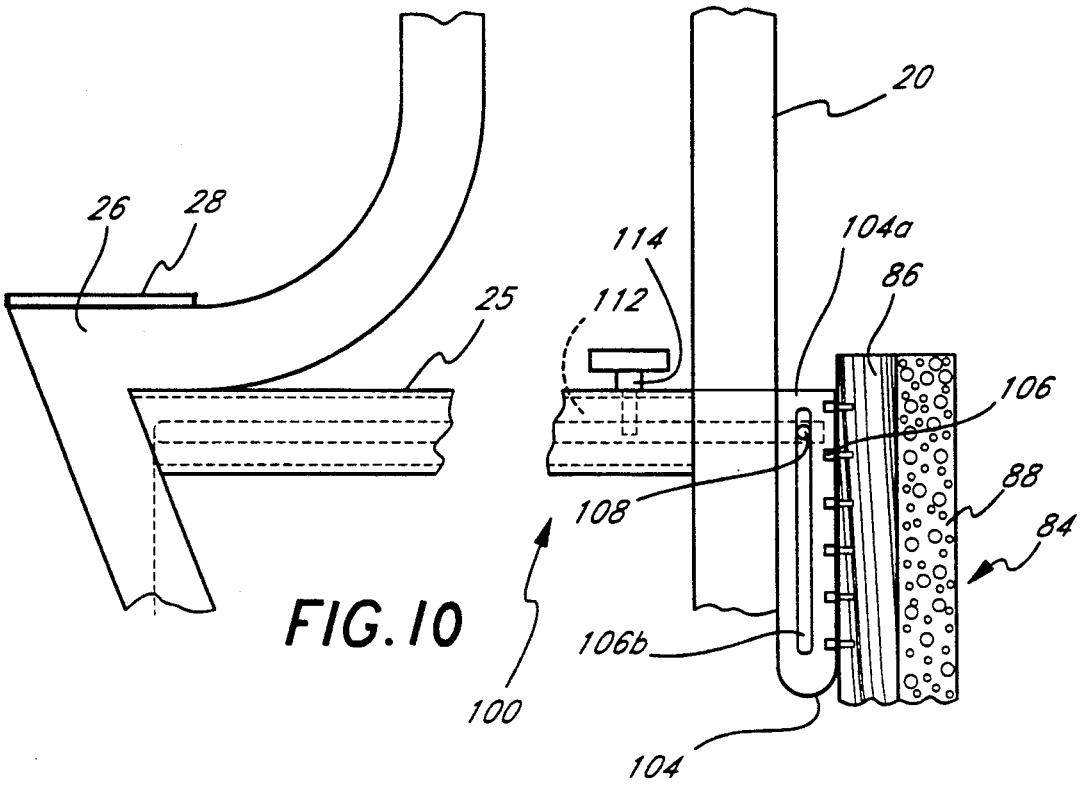
FIG. 10
FIG. 11
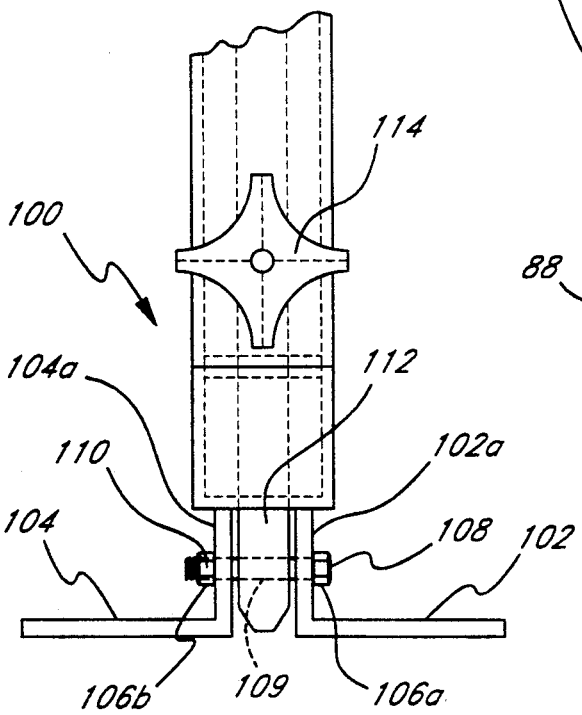
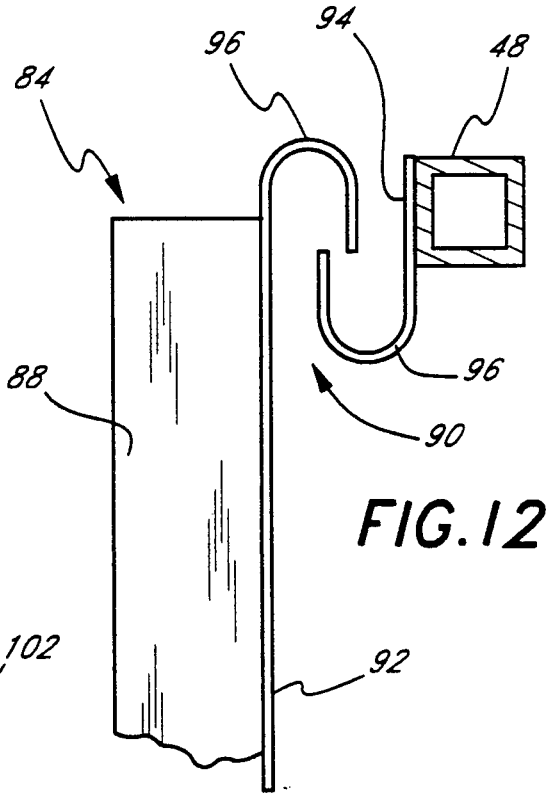
FIG. 12

FIG. 13
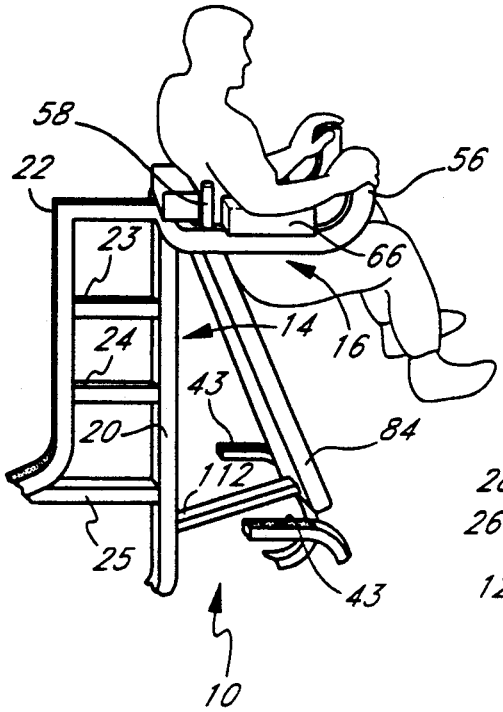
FIG. 14
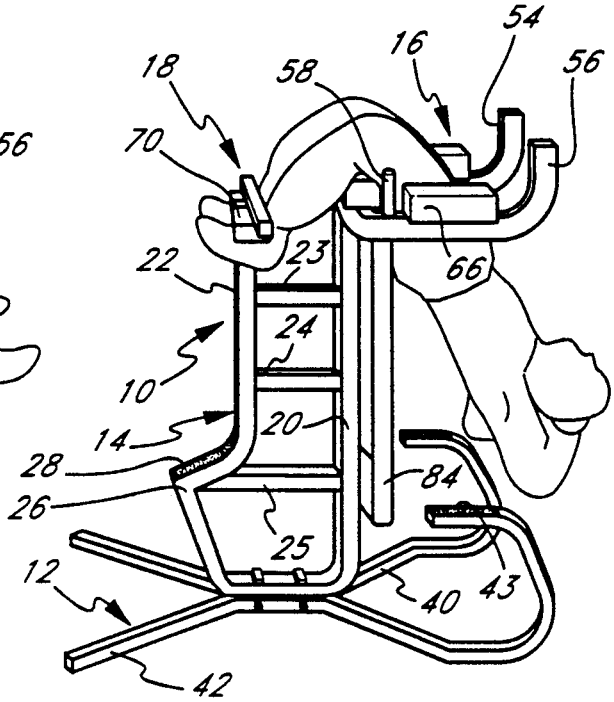
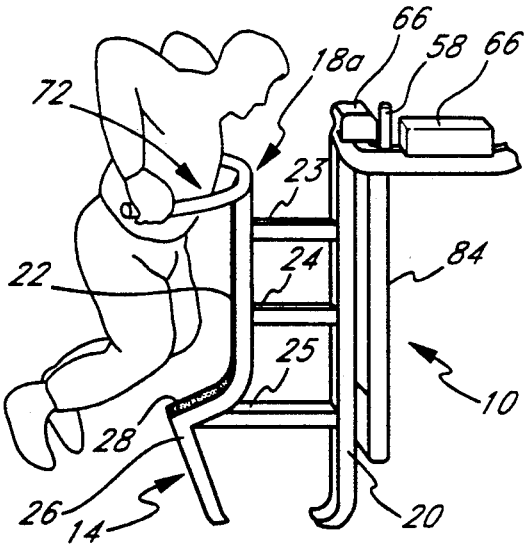
FIG. 15
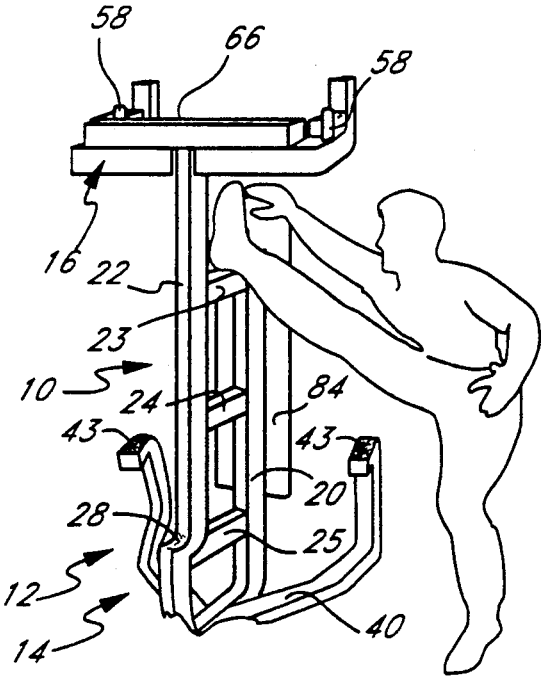
FIG. 16

EXERCISE DEVICE

BACKGROUND OF THE INVENTION

1. Field of the Invention

This invention relates to an exercise device which allows a user to perform several different types of exercises, including, for example, push ups, stretches, inverted sit-ups, bar-dips, and a Roman chair.

2. Background Discussion

There are several well-known exercise devices which are in common use. Frequently, these devices are limited in the number of exercises that can be performed, and they tend to add bulk to muscles and not simply strength.

SUMMARY OF THE INVENTION

It is objective of this invention to provide an improved exercise device which allows a user to conduct a variety of different exercises, is easy to assemble and use, is compact, is inexpensive to manufacture, is comfortable, and employs the weight of the user advantageously, allowing isokinetic exercises to be performed which add strength to muscles while limiting bulking of muscles.

The exercise device of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its advantages, which include versatility of the types of exercises which may be performed using this device, simplicity of use, space saving, comfort, low cost manufacture, and ease of assembly.

The first feature of the exercise device of this invention is that it includes an upright section, preferably including a ladder. The length of the upright section is from 3 to 6 feet. This is important so that while conducting exercises such as an inverted sit-up the user is elevated substantially above floor level.

The second feature is that the upright section is supported in a stable, vertical orientation by a base adapted to rest on a horizontal surface. The base includes a pair of substantially horizontal, elongated leg members removably attached to the lower portion of the upright section. Each leg member has (i) substantially the same configuration, (ii) a central section attached to a lower portion of the upright section, and (iii) a pair of load bearing elements diverging outward from the central section. One end of each load bearing element turns upward and inward to provide a foot step. Preferably, there are stabilizer means connected to the leg members and the lower portion of the upright section which strengthen and enhance the rigidity of the base and upright section so that the device is capable of supporting heavy loads during exercise.

The third feature is that the ladder has first an second parallel side rails, each terminating in a top end and connected to each other by at least one horizontal step member. The first rail has mounted at its top end a first support member oriented substantially at a right angle with respect to the first rail and adapted to be moved vertically between first and second positions. The first support member is designed so that a person may mount the device and sit on the first support member. This first support member includes a cross element having opposed ends and a pair of arm members. Each arm member extends outward from one of the opposed ends of the cross element and away from said first rail. The arm members and the cross element have pads preferably removably attached to their upper surfaces, and the arm members are each at substantially a right angle with respect to the cross element. Preferably, each arm member has an outer end which turns upward at approximately a right angle to form a hand grip. The cross element has a length of from 24 to 36 inches. This is important so that the torso of the person using the device may be positioned between the arm members while performing certain exercises.

The fourth feature is that the device includes a generally flat, planar, pivotally mounted back support. Preferably, the back support has its upper end mounted by hinge means to the cross element and a second free end movable between a first position where the back support is generally parallel to the first rail and a second position where the back support pivots about the hinge means and is at an acute angle with respect to the first rail. Preferably, back support has a pad removably attached to its top surface.

The fifth feature is that the device includes a second support member mounted at an upper end of the second rail of the ladder. This second support member may be raised and lowered to accommodate the user and the type of exercise being performed. Usually, the feet of the user are positioned beneath this second support member, and it preferably has pads removably attached to its lower surface.

The sixth feature is that the device is mainly made of a metal such as, for example, steel tubular material. The cross element of the first support member has connected to its central section a vertical piece which is slideably received within one tubular rail of the ladder. In one embodiment, the second support member includes a substantially horizontal cross piece having connected to its central portion a vertical piece which is slideably received within the other tubular rail of the ladder. In a second embodiment, the cross piece has opposed ends, and there is at each of these opposed ends of the cross piece an outward extending arm that is substantially horizontal and at a right angle with respect to the cross piece.

DESCRIPTION OF THE DRAWING

The preferred embodiments of this invention, illustrating all its features, will now be discussed in detail. These embodiments depicts the novel and non-obvious method and device of this invention shown in the accompanying drawing, which is for illustrative purposes only. This drawing includes the following figures (Figs.), with like numerals indicating like parts:

FIG. 3 is a third perspective view looking at the rear of the exercise device of this invention.

FIG. 7 is a plan view looking down at the top of the seat rest support member used in the exercise device of this invention.

FIG. 8 is a front elevational view of the seat rest support member, with its arm pads removed for clarity.

FIG. 9 is a side elevational view of the seat rest support member.

FIG. 10 is a fragmentary side view of the lower portion of the back support.

FIG. 11 is a plan view showing the coupling mechanism of the positioning rod for the back support.

FIG. 12 is a side view of the upper portion of the back support showing the hinge mounting connected to the seat rest support member.

FIG. 13 is a perspective view of a user performing a Roman chair exercise using the exercise device of this invention.

FIG. 14 is a perspective view of a user performing an inverted sit up exercise using the exercise device of this invention.

FIG. 15 is a perspective view of a user performing a bar dip exercise using the exercise device of this invention.

FIG. 16 is a perspective view of a user performing a leg stretching exercise using the exercise device of this invention.

DESCRIPTION OF THE PREFERRED EMBODIMENTS

Figure 1:
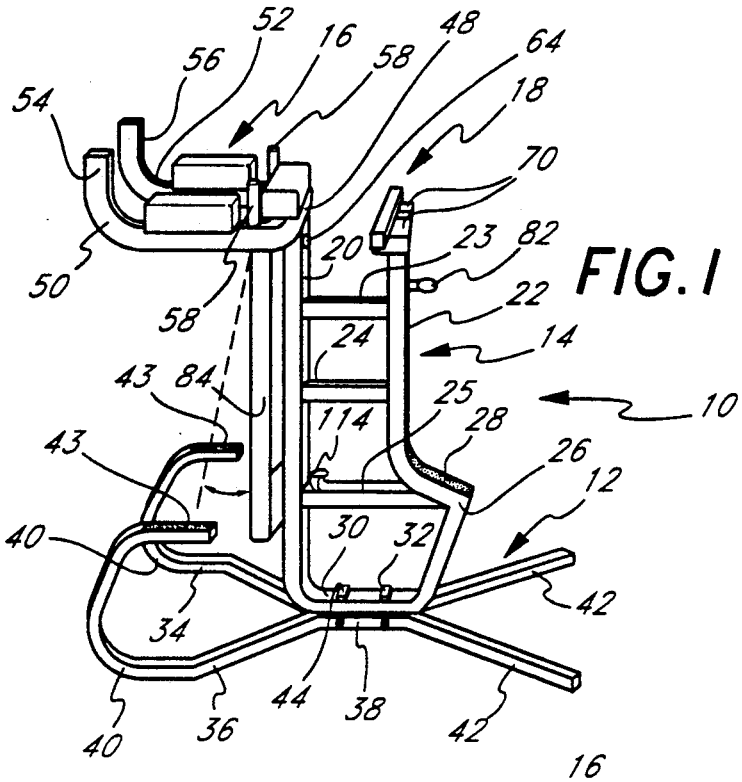
FIG. 1 is a perspective view looking at a side of the exercise device of this invention.
Figure 2:
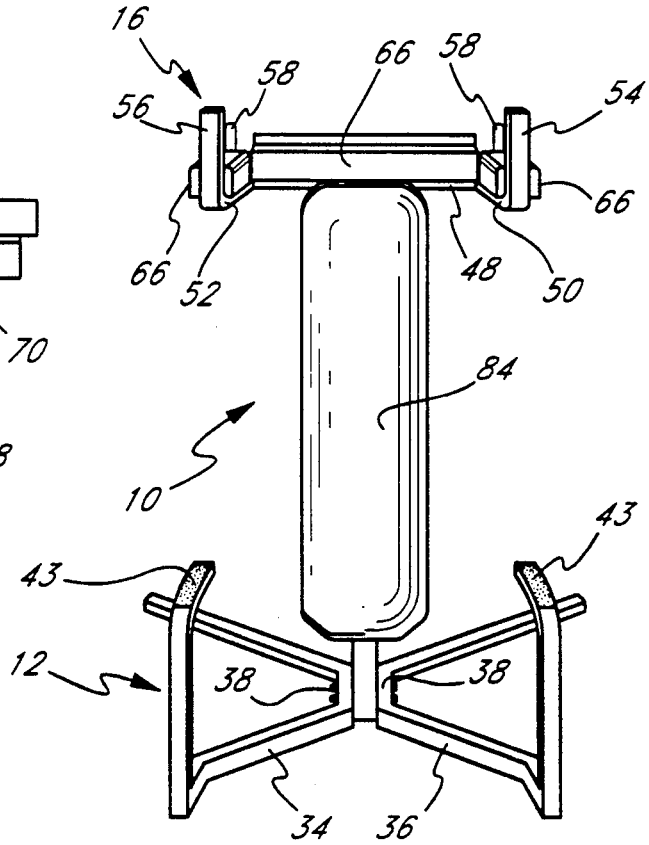
FIG. 2 is a second perspective view looking at the front of the exercise device of this invention.

As best illustrated in FIGS. 1 through 3, the exercise device 10 of this invention includes a base 12 which supports in a generally upright, vertical orientation, a ladder section 14. At the top of the ladder section 14 are two support structures: a seat rest support member 16 and a rear support member which in one embodiment is a foot rest support member 18 (FIGS. 1 and 2) and in another embodiment is a bar dip member 18*a* (FIGS. 3 and 15). The base 12, ladder section 14, and support members 16 and 18 are preferably all made of tubular steel having a generally square cross-section. Such tubular steel provides a rigid, durable, device which can support users weighing in excess of 300 pounds.

Figure 5:
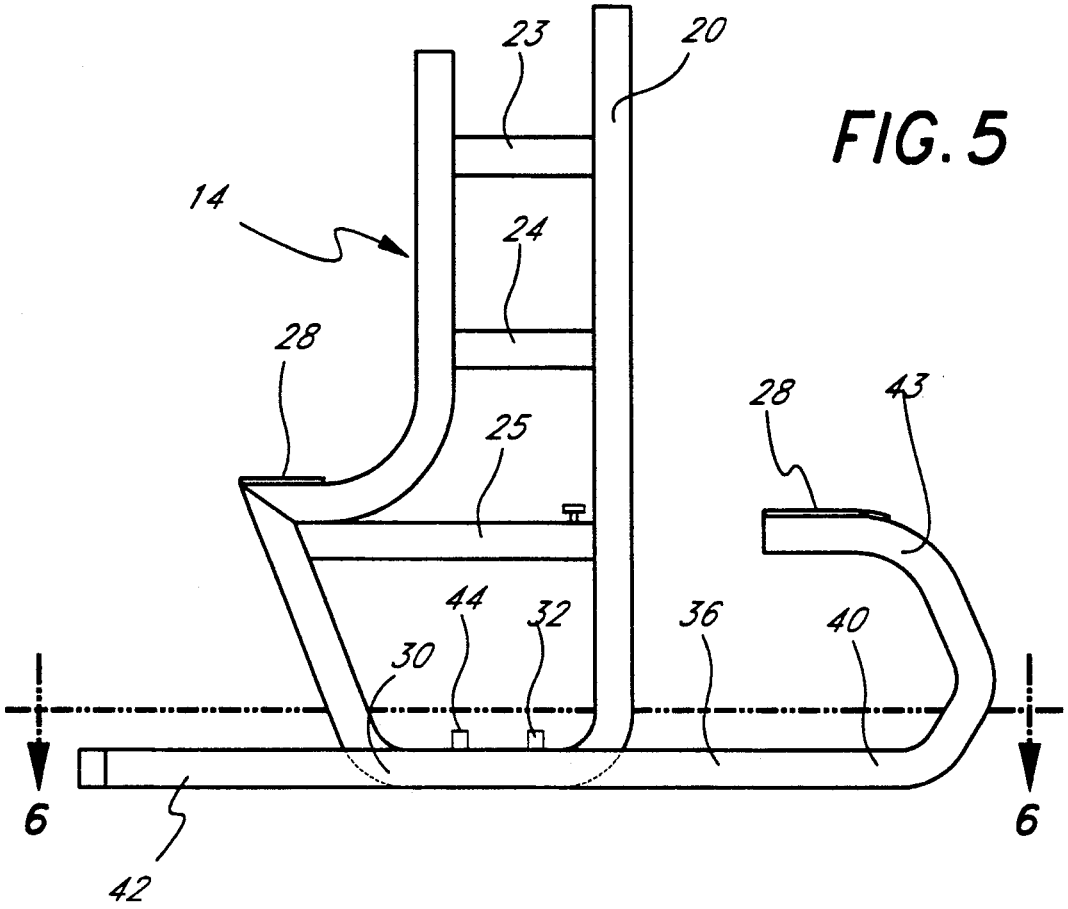
FIG. 5 is a side view of the ladder section used in the exercise device of this invention.

The ladder section 14 has a length ranging between about 3 and about 6 feet, so that the support members 16 and 18 are elevated well above floor level to enable a user to perform, for example, an inverted sit-up exercise as illustrated in FIG. 14. The ladder section 14 includes two rails 20 and 22, which are spaced apart and connected by, in this embodiment, three step members 23, 24, and 25. The one rail 22 has an outwardly projecting side step 26, which has an abrasive material 28 bonded to its surface which acts as an anti-slip agent. The top ends of the rails 20 and 22 are open, and the bottom ends of the rails are connected by a bottom brace 30. As best illustrated in FIG. 5 and 6, a finger 32 is welded crosswise to the bottom brace 30, with the ends of this finger extending beyond the sides of the bottom brace.

The base 12 includes two essentially identically configured left and right leg members 34 and 36, respectively. Each leg member 34 and 36 has a central section 38 with opposed ends having outwardly or diverging load-bearing elements 40 and 42. The upper surface of the central section 38 of each of the leg members 34 and 36 includes a finger 44 which extends sideways beyond this upper surface. Preferably, one end of each of the leg members is turned upward and inward to provide a footstep 43 approximately 8 to 16 inches above a supporting, horizontal surface such as a floor. The top portions of the footsteps 43 are covered with an abrasive material 28 that acts as an anti-slip agent.

Figure 6:
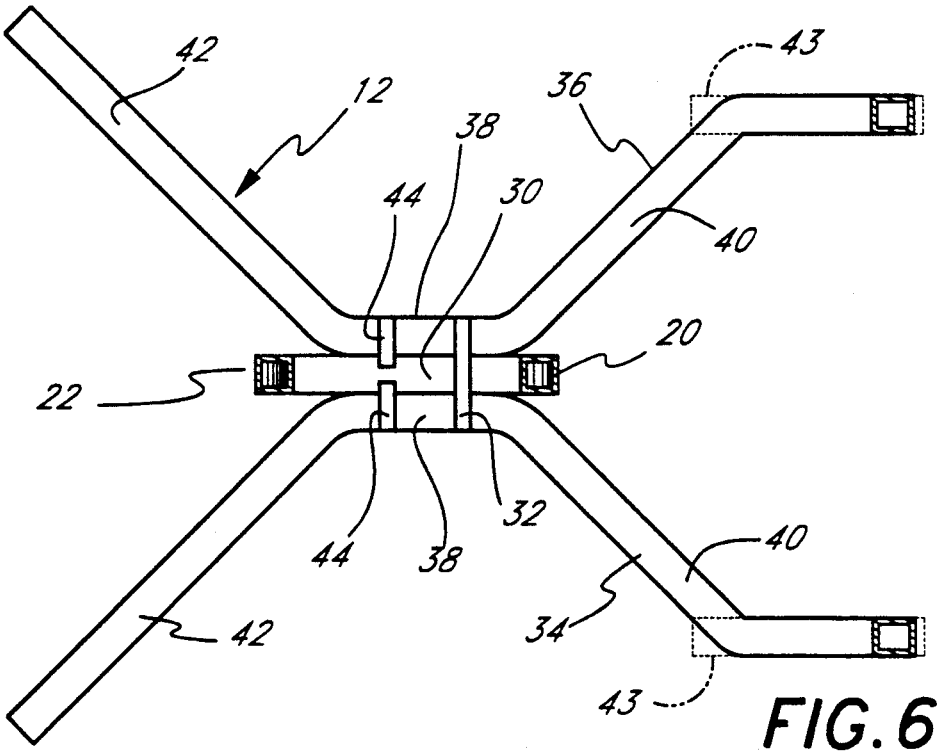
FIG. 6 is a cross-sectional view taken along line 6—6 of FIG. 5.

As illustrated best in FIG. 6, upon assembly, the fingers 44 are aligned with each other and overlap and abut the top surface of the bottom brace 30. The distal portions of the finger 38 which extend beyond the bottom brace 30 overlap and abut the top surfaces of the central sections 38 of the leg members 34 and 36. There are aligned holes in the sides of the central sections 38 of the leg members 34 and 36 and the bottom brace 30 which allow the leg members to be removeably fastened securely with conventional nut and bolt fasteners (not shown) to the bottom brace. The fingers 44 and the finger 32 are spaced apart from each other and co-act to provide a rigid, stable base 12 on which the ladder section 14 is supported in an upright, vertical orientation.

As depicted in FIGS. 7, 8 and 9, the seat rest support member 16 has a generally U-shaped configuration. It includes a cross element 48, having at each of the opposed ends of this cross element, outwardly extending arms 50 and 52. The cross element 48 has a width ranging between about 24 and about 36 inches, thus having sufficient width to allow the torso of a user to fit comfortably between the opposed arms 50 and 52 as depicted in FIG. 13 where a Roman chair exercise is being performed. The free ends of the arms 50 and 52 turn upward at a generally right angle and serve as hand grips 54 and 56, respectively. Near each opposed end of the cross element 48 is a upward, generally vertical hand post 58, which allows the user to position himself or herself, depending upon the exercise being conducted.

As illustrated in FIGS. 8 and 9, the seat rest support member 16 includes a generally downward extending leg 60 which fits telescopically within the open top end of the rail 20. This leg 60 has a plurality of spaced apart holes 62 drilled through its tubular wall that allows a positioning pin 64 to be inserted through one of the holes 62. This allows the support member 16 to be elevated or lowered, depending upon the size of the user. The upper surfaces of the arms 50 and 52 and cross element 48 each have pads 66 removably attached to these surfaces. Preferably, there is bonded to these surfaces the hook element of a hook-and-fabric type fastener such as sold by the Velcro® Corporation. The fabric portion of the fastener is attached to the undersides of the pads 66, and pressed against the hook elements to secure the pads to the surfaces.

Figure 4:
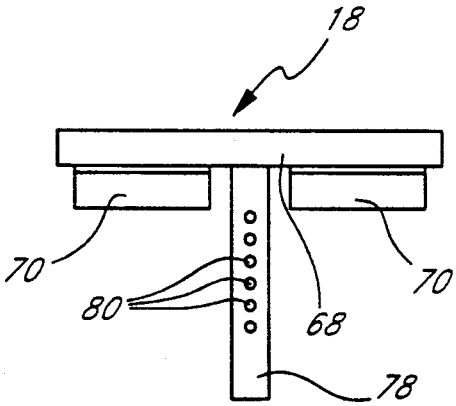
FIG. 4 is a front elevational view of the foot rest support member used in the exercise device of this invention.

There are at least two different types of rear support members may be used with the exercise device 10: the foot rest support member 18 and the bar dip support member 18*a*. As depicted in FIG. 4, the foot rest support member 18 has a generally T-shape, and it includes a cross-piece 68, which is used when performing, for example, an inverted sit-up exercise as shown in FIG. 14. The cross-piece 68 includes pads 70 removeably attached to the underside surface of the cross-piece preferably using Velcro®-type fasteners. As depicted in FIGS. 3 and 15, the bar dip support member 18*a* has a generally U-shaped, horizontal cross-piece 72. This cross-piece 72 has outwardly projecting hand grips 74 and 76 which are grasped upon performing a bar-dip exercise as shown in FIG. 15. Each of these rear support members 18 and 18*a* includes a leg element 78 having a series of holes 80 drilled through the tubular wall of each leg element. The leg element 78 is inserted into the open top of the rail 22 and a positioning pin 82 (FIGS. 1 and 3) located in the rail 22 is inserted into a selected hole 80 to position either embodiment of the support members 18 at different elevations, depending upon the size of the user.

In accordance with an important feature of this invention, there is a back support 84 which includes a generally flat, planar member 86 (FIG. 10) preferably of wood covered by a removable pad 88 using Velcro® fasteners as discussed above. The planar member 86 has a length of from about 30 to about 54 inches and is attached at its upper end by a hinge 90 to the cross element 48 of the seat rest support member 16. The hinge 90 comprises two plates 92 and 94, each having a J-cross sectional section 96 at a distal end. The plate 92 is securely fastened by bolts (not shown) to the upper end of the planar member 86, and the plate 94 is securely fastened by bolts (not shown) to the cross element 48.

A coupling mechanism 100 for adjusting the position of the back support 84 is illustrated in FIGS. 3, 10, 11, and 13. This coupling mechanism 100 includes a pair of spaced apart L-shaped plates 102 and 104 having aligned angle sections 102*a* and 104*a*, respectively. The aligned angle sections 102*a* and 104*a* each have slots 106*a* and 106*b*, respectively, and these slots are aligned and receive a bolt 108 which passes through a hole 109 (FIG. 11) in the end of a rod 112 that is telescopically received within the tubular step member 25. A nut 110 secures the bolt in position. The rod 112 is generally at a right angle to the planar member 86 when this member is in the vertical position. The rod 112 has a series of spaced holes (not shown) drilled in it that allow a positioning pin 114 to be inserted into a selected hole to retain the lower end of the back support 84 in a displaced position away from the one rail 20 and at an acute angle with respect to this rail as illustrated in FIG. 13. As the back support 84 pivots about the hinge 90 and its lower end moves upward upon being moved between the vertical to a displaced position, the shaft of the bolt 108 slides in the slots 106*a* and 106*b*. Thus, the back support 84 may be positioned in a generally vertical position as illustrated in FIG. 14, or at one of several different acute angle positions, depending upon the positioning of the rod 112.

In accordance with this invention, the exercise device 10 is easy to mount using the footsteps 26 and 43 and ladder section 14. It is comfortable because of the replaceable pads 66, 70, and 84, which may be replaced when worn. The device 10 may be used to perform a variety of stretching exercises, for example, the leg stretch illustrated in FIG. 16. It is easy to assemble and disassemble, and may be used with weights and other accessories. And most importantly, the user employ his or her own weight to perform many different exercises which are impractical or impossible to perform using conventional equipment.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

We claim:

1. An exercise device including:

a ladder section, a base adapted to reset on a horizontal surface and support in a stable, upright, vertical orientation said ladder section, said ladder section having first and second vertically extending side rails each terminating in a top end and connected to each other by at least one horizontal step member, a first support member including a cross element having opposed ends, each end including an arm member, said arm members extending from the opposed ends of said cross element substantially at right angles, first support member being mounted to only the top end of said first side rail along said cross element, so as to position said arms members to extend away from said second rail along a generally horizontal axis, said first support member adapted to be moved vertically between first and second positions, a generally flat planar back support having a first end mounted by hinge means to the cross element and a second free end movable between a first position where the back support is generally parallel to the first rail and a second position where the back support pivots about the hinge means and is at an acute angle with respect to the first rail, and a second support member mounted at the top end of said second rail.

2. The exercise device of claim 1 where the arm members and the cross element have pads attached to upper surfaces of the arm members and the cross element.

3. The exercise device of claim 2 where the pads are removably attached to said upper surfaces.

4. The exercise device of claim 1 where the second support member has pads attached to a lower surface of said second support member.

5. The exercise device of claim 4 where the pads are removably attached to said lower surface.

6. The exercise device of claim 1 where the arm members are each at substantially a right angle with respect to the cross element.

7. The exercise device of claim 6 where each arm member has an outer end which turns upward at approximately a right angle to form a hand grip.

8. The exercise device of claim 7 including a pair of hand posts, one hand post near each opposed end of the cross element.

9. The exercise device of claim 1 where the base includes a pair of substantially horizontal leg members removably attached to the lower portion of the ladder section.

10. The exercise device of claim 9 where each leg member has (i) substantially the same configuration, (ii) a central section attached to a lower portion of the ladder section, and (iii) a pair of load bearing elements diverging outward from the central section, one end of each load bearing element nearest the first rail turning upward and inward to provide a foot step.

11. The exercise device of claim 9 where there are stabilizer means connected to the leg members and the lower portion of the ladder section.

12. The exercise device of claim 1 where there is a foot step along the outside of the second rail between the base and the top end of the second rail.

13. The exercise device of claim 1 where the rails are made of tubular material.

14. The exercise device of claim 13 where the cross element of the first support member has a vertical piece connected to a central section of the cross element which is slideably received within the tubular first rail.

15. The exercise device of claim 13 where the second support member includes a substantially horizontal cross piece and a vertical piece which is connected to a central portion of the cross piece and is slideably received with the tubular second rail.

16. The exercise device of claim 15 where the cross piece has opposed ends, and there is at each of said opposed ends of the cross piece an outward extending arm that is substantially horizontal and at a right angle with respect to the cross piece.

17. The exercise device of claim 1 where the body support section is from 3 to 6 feet above the base, and the upright section includes a ladder member.

18. The exercise device of claim 1 where the first support member includes a cross element having a length of from 24 to 36 inches, said cross element having opposed ends and a pair of arm members, each arm member extending outward from one of the opposed ends of the cross element and away from said upright section.

* * * * *